US006677920B2

(12) United States Patent
Huang et al.

(10) Patent No.: US 6,677,920 B2
(45) Date of Patent: Jan. 13, 2004

(54) METHOD OF DRIVING A PLASMA DISPLAY PANEL AND APPARATUS THEREOF

(75) Inventors: Jih-Fon Huang, Hsinchu Hsien (TW); Shin-Tai Lo, Miaoli Hsien (TW)

(73) Assignee: AU Optronics Corp., Hsinchu (TW)

( * ) Notice: Subject to any disclaimer, the term of this patent is extended or adjusted under 35 U.S.C. 154(b) by 254 days.

(21) Appl. No.: 09/810,360

(22) Filed: Mar. 16, 2001

(65) Prior Publication Data

US 2002/0036602 A1 Mar. 28, 2002

(30) Foreign Application Priority Data

Sep. 21, 2000 (TW) ..... 89119450 A

(51) Int. Cl.[7] ..... G09G 3/28

(52) U.S. Cl. ..... 345/60; 345/60; 345/67; 345/41; 345/42; 315/169.1; 315/169.2; 315/169.4; 313/582; 313/584; 313/590

(58) Field of Search ..... 345/35–37, 41–43, 345/55, 58, 62, 66–68, 215; 315/169.1, 169.2, 169.4; 313/581, 582, 584, 590

(56) References Cited

U.S. PATENT DOCUMENTS 5,446,344 A * 8/1995 Kanazawa ..... 313/585
5,790,087 A * 8/1998 Shigeta et al. ..... 345/62
5,952,986 A * 9/1999 Nguyen et al. ..... 345/209
5,963,184 A * 10/1999 Tokunaga et al. ..... 315/169.4
6,037,916 A * 3/2000 Amemiya ..... 345/60
6,160,529 A * 12/2000 Asao et al. ..... 345/60
6,184,848 B1 * 2/2001 Weber ..... 345/60
6,262,699 B1 * 7/2001 Suzuki et al. ..... 345/60
6,323,830 B1 * 11/2001 Huang ..... 315/169.1
6,356,249 B1 * 3/2002 Lim ..... 345/63
6,373,452 B1 * 4/2002 Ishii et al. ..... 315/169.4

* cited by examiner

*Primary Examiner*—Richard Hjerpe
*Assistant Examiner*—Henry N. Tran
(74) *Attorney, Agent, or Firm*—Ladas & Parry

(57) ABSTRACT

A PDP driving method, at the first timing point of a reset period, a global voltage difference is applied between the sustaining electrodes and the scanning electrodes, wherein the gaseous discharge occurs only in the non-display areas, called the dark areas. Because the discharge during reset period does not occur in the display areas, the picture quality is assured from avoiding the emission of over-brightness in the reset period which enables the sequential gaseous discharge operations to proceed with smaller driving voltage.

9 Claims, 7 Drawing Sheets

METHOD OF DRIVING A PLASMA DISPLAY PANEL AND APPARATUS THEREOF

BACKGROUND OF THE INVENTION

1. Field of the Invention

The present invention generally relates to a method of driving a plasma display panel (hereinafter referred to as PDP) and its apparatus. More specifically, the method and apparatus of the present invention can reduce the back-glow phenomena caused by the discharge operation during the reset period for a PDP, therefore, enhancing the contrast of the plasma display panel.

2. Description of the Related Art

Plasma display is one of most promising flat panel display technologies because it can provide a large and flat display screen and can display full-color images. The basic theory and operation of a PDP is described below.

FIG. 1 is a cross-sectional view of a conventional PDP cell constructed by two glass substrates 1 and 7 and the components formed thereon. Inert gases, such as Ne and Xe, are filled in the cavity between the glass substrates 1 and 7. The components formed on the glass substrate 1 include sustaining electrodes X, scanning electrodes Yi, a dielectric layer 3 and a protective film 5. The components formed on the glass substrate 7 include address electrodes Aj and the fluorescent material 9 formed thereon. The rib 8 is formed on the peripheral of each PDP cell to isolate the PDP cell. Therefore, each PDP cell 10 includes three kinds of electrodes, i.e., the sustaining electrode X and the scanning electrode Yi, which is parallel to each other, and the address electrodes Aj crossing vertically the sustaining electrode X and the scanning electrode Yi.

FIG. 2 is a block diagram illustrating a plasma display formed by the PDP cells shown in FIG. 1. As shown in the drawing, the PDP 100 is driven by the scanning electrodes Y1~Yn, the sustaining electrodes X and the address electrodes A1~Ap. The position of the cell 10 is as shown in the drawing. Each cell is isolated by the rib 8 as shown in FIG. 1. Furthermore, the plasma display includes the control circuit 110, the Y scanning driver 112, the X sustaining driver 114 and the address driver 116. The control circuit 110 generates timing signals for the drivers according to the external clock signal CLOCK, the data signal DATA, the vertical synchronous signal VSYNC and the horizontal synchronous signal HSYNC, wherein the clock signal CLOCK represents the data transmittal clock, the data signal DATA represents the display data, and the vertical synchronous signal VSYNC and the horizontal synchronous signal HSYNC are respectively used to define the timing sequences of a frame and a scanning line. The control circuit 110 sends the display data and the clock signal to the address driver 116 and sends the corresponding frame control clock to the Y scanning driver 112 and the sustaining driver 114. The display data is sequentially transmitted to the address driver 116 by the control circuit 110 and wall charges are built to selected cell by the address discharges. Address discharges are caused by the data pulses of address electrodes A1~Ap and the scanning pulses of scanning electrodes Y1~Yn which are sequentially sent by the Y scanning driver 112. The detailed operation and the control signals for the electrodes are described below.

FIG. 3 is a diagram illustrating the manner to drive a conventional PDP to display a frame. As shown in the drawing, each frame is divided into eight sub-fields SF1~SF8. Each sub-field includes three operating period, that is, the reset period R1~R8, the address period A1~A8 and the sustain period S1~S8. In the reset period, the residual charges of the former sub-field are cleared to make the initial conditions of all cells before the address period almost the same. In the address period, the address discharges are initiated in the selected cells according to the display data and then wall charges are accumulated. In the sustain period, sustain discharges for displaying are repeatedly initiated and visible light can be produced in the cells which have accumulated charges through the address discharge in the address period. All of the PDP cells are processed at the same time during the reset period R1~R8 and the sustain period S1~S8. The address operation is sequentially performed for each cell on the scanning electrodes Y1~Yn during the address period A1~A8. Moreover, the display brightness is proportional to the length of the sustain period S1~S8. In the example of FIG. 3, the length of the sustain periods S1~S8 of the sub-fields SF1~SF8 can be set in a ratio of 1:2:4:8:16:32:64:128 to display images in 256 gray scales.

FIG. 4 is a timing diagram of the voltage waveforms on the electrodes in a single sub-field of the prior art. The voltage waveforms on the address electrodes Aj are generated by the address driver 116, the voltage waveforms on the sustaining electrodes X are generated by the X sustaining driver 114, and the voltage waveforms on the scanning electrodes Y1~Yn are generated by the Y scanning driver 112. As shown in the drawing, each sub-field includes the reset period, the address period and the sustain period. The voltage waveforms in each period and the resulted manners are described in detail below.

At the time point a (in FIG. 4) of the reset period, the voltage of the scanning electrodes Y1~Yn is set to 0 V, and a write pulse having a voltage of VS+VW is applied to the sustaining electrode X, in which the voltage VS+VW is larger than the firing voltage between the sustaining electrode X and the scanning electrode Yi. Therefore, the global writing discharge W occurs between the sustaining electrode X and the scanning electrodes Yi. This discharge process accumulates negative charges on the sustaining electrode X and positive charges on the scanning electrodes Yi. The electric field produced by the accumulated negative charges and the positive charges will cancel out the voltage difference between the sustaining electrodes, thus the time of global writing discharge W is very short.

At the time point b, the sustaining electrode X is set to 0 V, and a sustaining pulse 202 having a voltage of VS is applied to all of the scanning electrodes Y1~Yn, wherein the value of the voltage VS plus the voltage caused by the charges accumulated between the sustaining electrodes must be larger than the firing voltage between the scanning electrodes Yi and the sustaining electrode X. Thus, the global sustaining discharge S occurs between the sustaining electrode X and the scanning electrodes Yi. Different from the previous discharge process, this discharge process accumulates positive charges on the sustaining electrode X and negative charges on the scanning electrodes Yi.

At the time point c, the scanning electrode Yi is set to 0 V, an erase pulse 203 having a voltage lower than VS is applied to the sustaining electrode X, and an address pulse having a voltage of −VS can be applied to the address electrode Aj. The erase pulse is used to neutralize a part of the charges. On the scanning electrodes Y1~Yn, required wall charges are left so that the write operation can proceed with a lower voltage in the sequential address period.

In the address period, the voltage of the sustaining electrode X and the scanning electrodes Yi are pulled up to VS at the time point d. Then a scan pulse 204 is sequentially applied to the scanning electrodes Y1~Yn from the time point e, and an address pulse having a voltage of VA is applied to the address electrode Aj at the same time. When a cell of a scanning line turns ON, the write discharge occurs, that is, the corresponding display data is written into the cell.

After scanning all of the scanning electrodes Y1~Yn, the sustain period begins. The sustaining electrode X and the scanning electrode Yi are first set to 0 V. Then the sustaining pulses 205 having the same voltage are applied to the sustaining electrode X and the scanning electrodes Yi in an alternate way, i.e., at the time point f and at the time point g. Thus, the cell with the data ON during the address period will irradiate. It should be noted that the waveform of driving signals described above is only an example. The waveform varies in practice, but the same theory is applied.

As described above, the length of the sustain period is proportional to the displayed brightness. Assume that a frame includes 510 sustain periods, in which each sustaining discharge period has two periods of discharge. The number of sustain periods for the sub-fields SF1~SF8 can be 2, 4, 8, 16, 32, 64, 128, and 256, respectively. Therefore, there are 1020 periods of discharge of the sustain period during the display period of a frame. This discharge operation enables a PDP device to display images.

On the other hand, 2 to 3 discharges, such as global writing discharge, global sustaining discharge and erase discharge, are performed during the reset period to uniformly distribute the wall charges. The discharges during the reset period can also make the PDP device irradiate with a brightness brighter than that produced by the discharge during the sustain period. Roughly speaking, the brightness produced by three periods of discharge during the reset period is about the brightness by five periods of discharge during the sustain period. The ratio of the highest brightness and the lowest brightness for the PDP device is about 1020:(5×8)=26:1, in which 1 corresponds to the brightness of black. Therefore, the brightness produced by the discharge during the reset period should be as low as possible in order to improve the image quality of black, which is an important factor for displaying images. It is thus a significant issue to reduce the brightness produced by the discharge during the reset period.

SUMMARY OF THE INVENTION

Therefore, an object of the present invention is to provide a driving method of plasma display panels, with a plurality of sustaining electrodes ($X_1$~$X_m$) and a plurality of scanning electrodes ($Y_1$~$Y_n$), configured in parallel and in an alternate sequence, and a plurality of address electrodes perpendicularly crossed over the sustaining electrodes and scanning electrodes; the dark areas $G_j$ are defined between the scanning electrodes $Y_j$ and sustaining electrodes $X_j$; and the display areas $D_j$ are defined between the scanning electrodes $Y_j$ and sustaining electrodes $X_{j+1}$ (n, m and j are integers, and $1 \leqq j \leqq n$ and m). At the first timing point, applying a global writing voltage difference $V_w$ between the scanning electrodes $Y_j$ and sustaining electrodes $X_j$, and there is no voltage difference between the scanning electrodes $Y_j$ and sustaining electrodes $X_{j+1}$. The global writing voltage difference $V_w$ is greater than the firing voltage between the scanning electrodes $Y_j$ and sustaining electrodes $X_j$; whereby, the gas discharges are occurred between the scanning electrodes $Y_j$ and sustaining electrodes $X_j$, which generates space charges and wall charges in the dark areas $G_j$. Because the voltage difference between the scanning electrodes $Y_j$ and sustaining electrodes $X_{j+1}$ is below the firing voltage of the gas, there is no priming discharge operation in the display areas $D_j$.

Another object of the present invention is to provide a second driving method of plasma display panels, wherein, a plurality of sustaining electrodes ($X_1$~$X_m$) and a plurality of scanning electrodes ($Y_1$~$Y_n$) configured in a sequence as $X_1$-$X_2$-$Y_1$-$Y_2$-$X_3$-$X_4$ . . . $X_{m-1}$-$X_m$-$Y_{n-1}$-$Y_n$, and a plurality of address electrodes perpendicularly crossed over the sustaining electrodes and scanning electrodes; wherein, the dark areas $XG_k$ are defined between the sustaining electrodes $X_{2k-1}$ and the sustaining electrodes $X_{2k}$, and the dark areas $YG_k$ are defined between the scanning electrodes $Y_{2k}$ and the scanning electrodes $Y_{2k-1}$. And the display areas $D_{2k-1}$, are defined between the sustaining electrodes $X_{2k}$ and the scanning electrodes $Y_{2k-1}$, and the display areas $D_{2k}$ are defined between the scanning electrodes $Y_{2k}$ and the sustaining electrodes $X_{2k+1}$ (n, m and j are integers, and $1 \leqq j \leqq n$ and m). Wherein, at the first timing point in the reset period, apply a global writing voltage difference $V_w$ to the dark areas $XG_k$ and $YG_k$, but there is no voltage difference in the display areas $D_{2k-1}$ and $D_{2k}$. The global writing voltage difference is greater than the firing voltage between the adjacent pairs of the sustaining electrodes $X_{2k-1}$ and $X_{2k}$, and the adjacent pairs of the scanning electrodes $Y_{2k-1}$ and $Y_{2k}$; whereby, the gas discharges are occurred in the dark areas $XG_k$ and $YG_k$ for the generation of space charges and wall charges, but do not proceed with the discharge operation in the display areas $D_{2k-1}$ and $D_{2k}$.

These and further features, aspects and advantages of the present invention, as well as the structure and operation of various embodiments thereof, will become readily apparent with reference to the following detailed description of a presently preferred, but nonetheless illustrative embodiment when read in conjunction with the accompanying drawings, in which like reference numbers indicate identical or functionally similar elements throughout the enumerated Figures.

BRIEF DESCRIPTION OF THE DRAWINGS

The drawings referred to herein will be understood as not being drawn to scale except if specially noted, the emphasis instead being placed upon illustrating the principles of the present invention. In the accompanying drawings.

DETAILED DESCRIPTION OF THE PREFERRED EMBODIMENTS

Reference is now made in detail to an embodiment of the present invention that illustrates the best mode presently contemplated by the inventor(s) for practicing the present invention. Other embodiments are also described herein.

Figure 1:
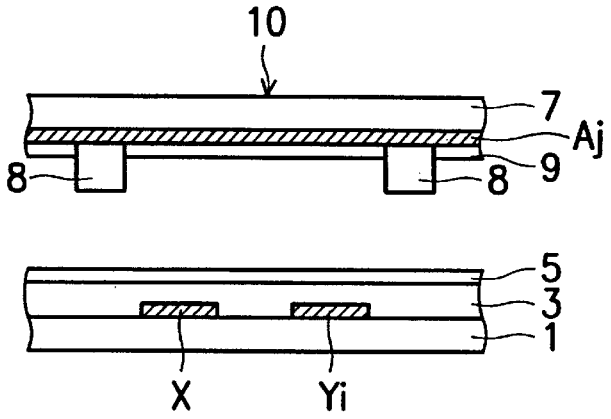
FIG. 1 ( PRIOR ART )
FIG. 1 represents the side view of the dissection graph of the cells in a conventional PDP.
Figure 2:
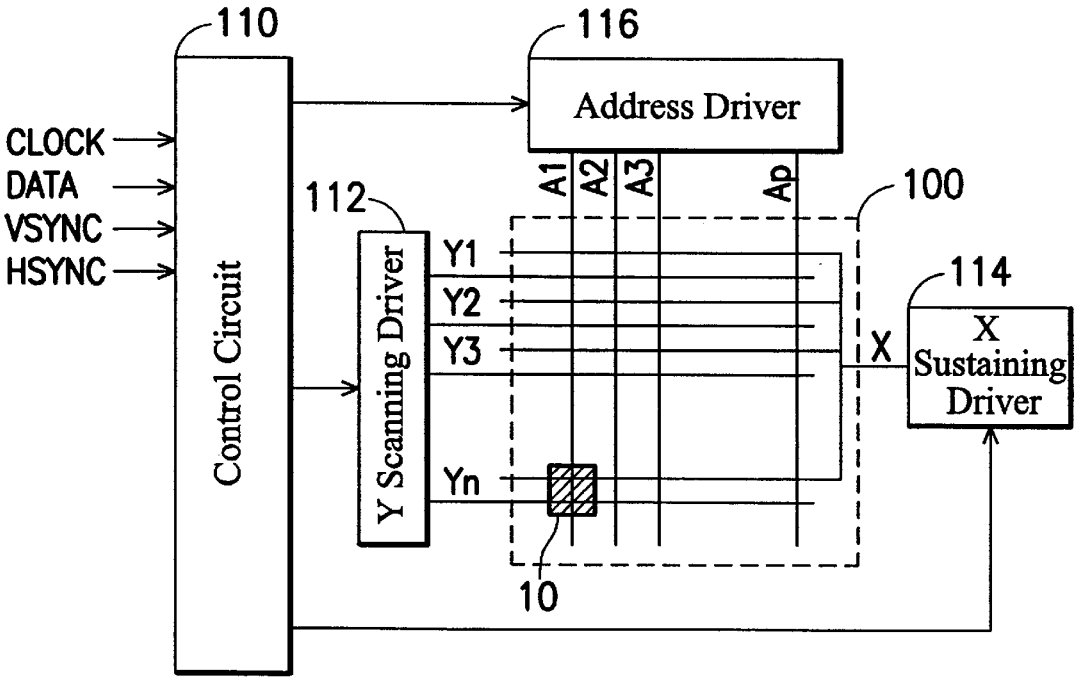
FIG. 2 ( PRIOR ART )
FIG. 2 represents the block diagram of the PDP device comprised of the PDP in FIG. 1.
Figure 3:
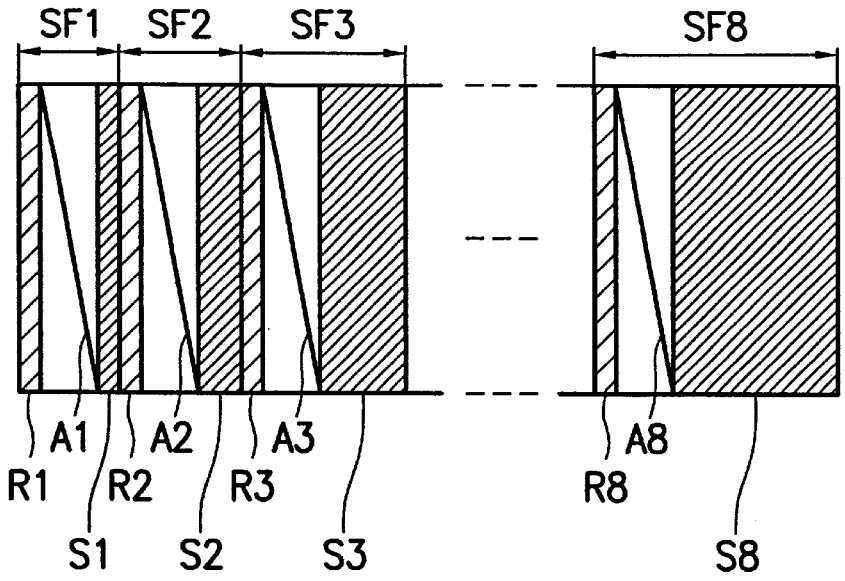
FIG. 3 ( PRIOR ART )
FIG. 3 represents the schematic diagram of the conventional PDP in a display mode.
Figure 4:
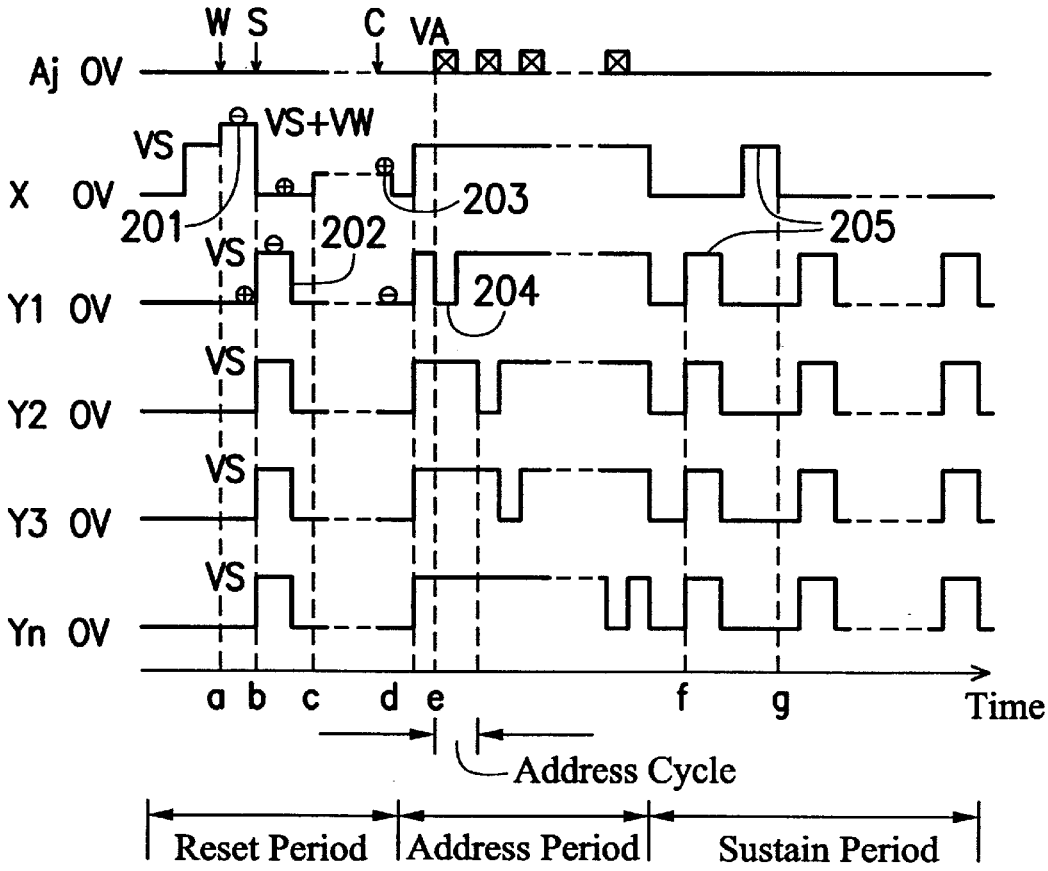
FIG. 4 ( PRIOR ART )
FIG. 4 is a timing diagram of the control signals for the electrodes including the address electrodes Ai, the sustaining electrodes X and the scanning electrodes Yi in a single sub-field according to the prior art.
Figure 5:
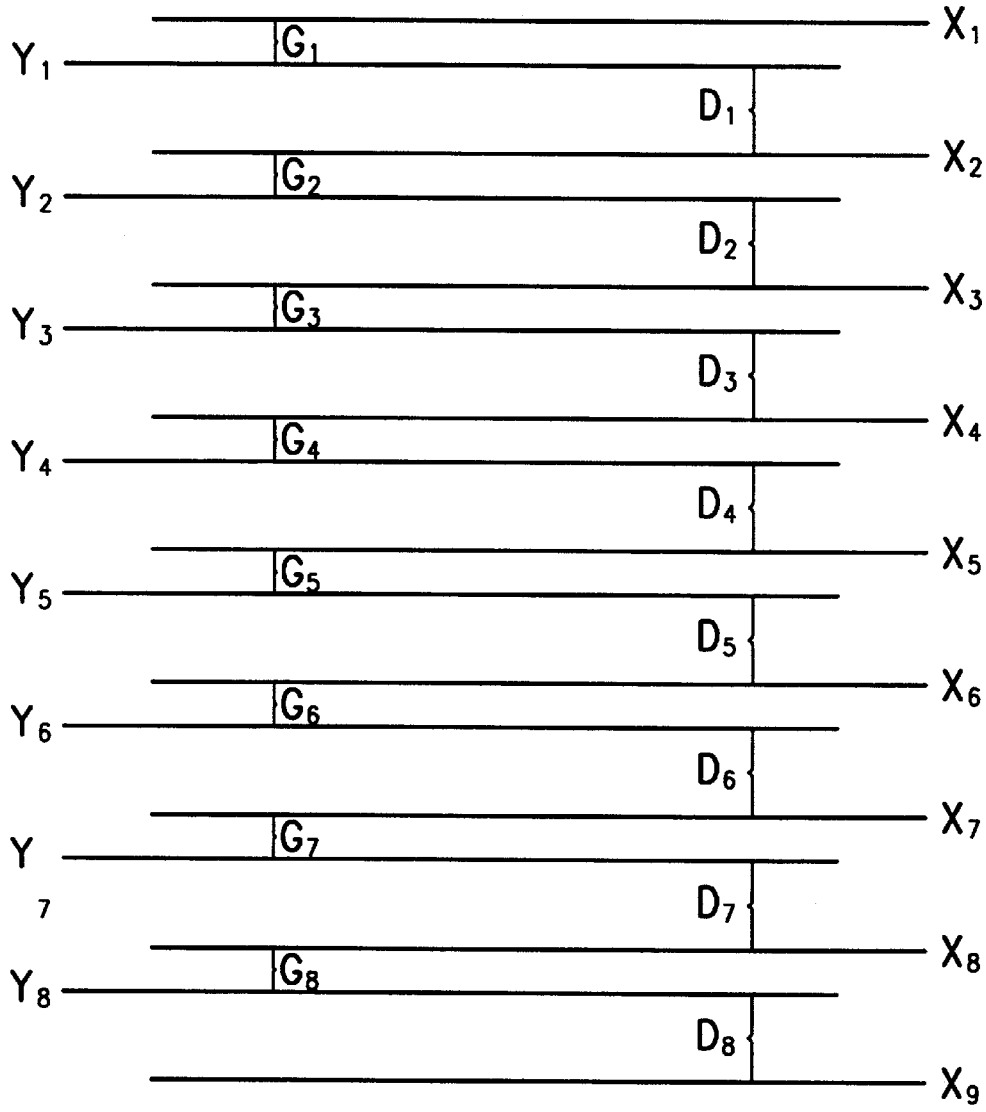
FIG. 5 is a schematic diagram of the sustaining electrodes and the scanning electrodes on the PDP (X-Y-X-Y) of the first embodiment of the present invention.

FIG. 5 is a schematic diagram of the sustaining electrodes and the scanning electrodes on the PDP of the first embodiment of the present invention. The PDP herein includes a plurality of sustaining electrodes ($X_1$~$X_m$) and scanning electrodes ($Y_1$~$Y_j$) configured alternately, and a plurality of address electrodes perpendicularly crossed over the sustaining electrodes and the scanning electrodes. For the purpose of illustration, the PDP in FIG. 5 has adopted the configuration of 9 sustaining electrodes ($X_1$~$X_9$) and 8 scanning electrodes ($Y_1$~$Y_8$) as the example. The spaces between any pairs of the scanning electrodes $Y_j$ and sustaining electrodes $X_j$ are defined as the dark areas $G_j$ (j=1~8), and that the spaces between the scanning electrodes $Y_j$ and the sustaining electrodes $X_{j+1}$ are defined as the display areas $D_j$.

Figure 6:
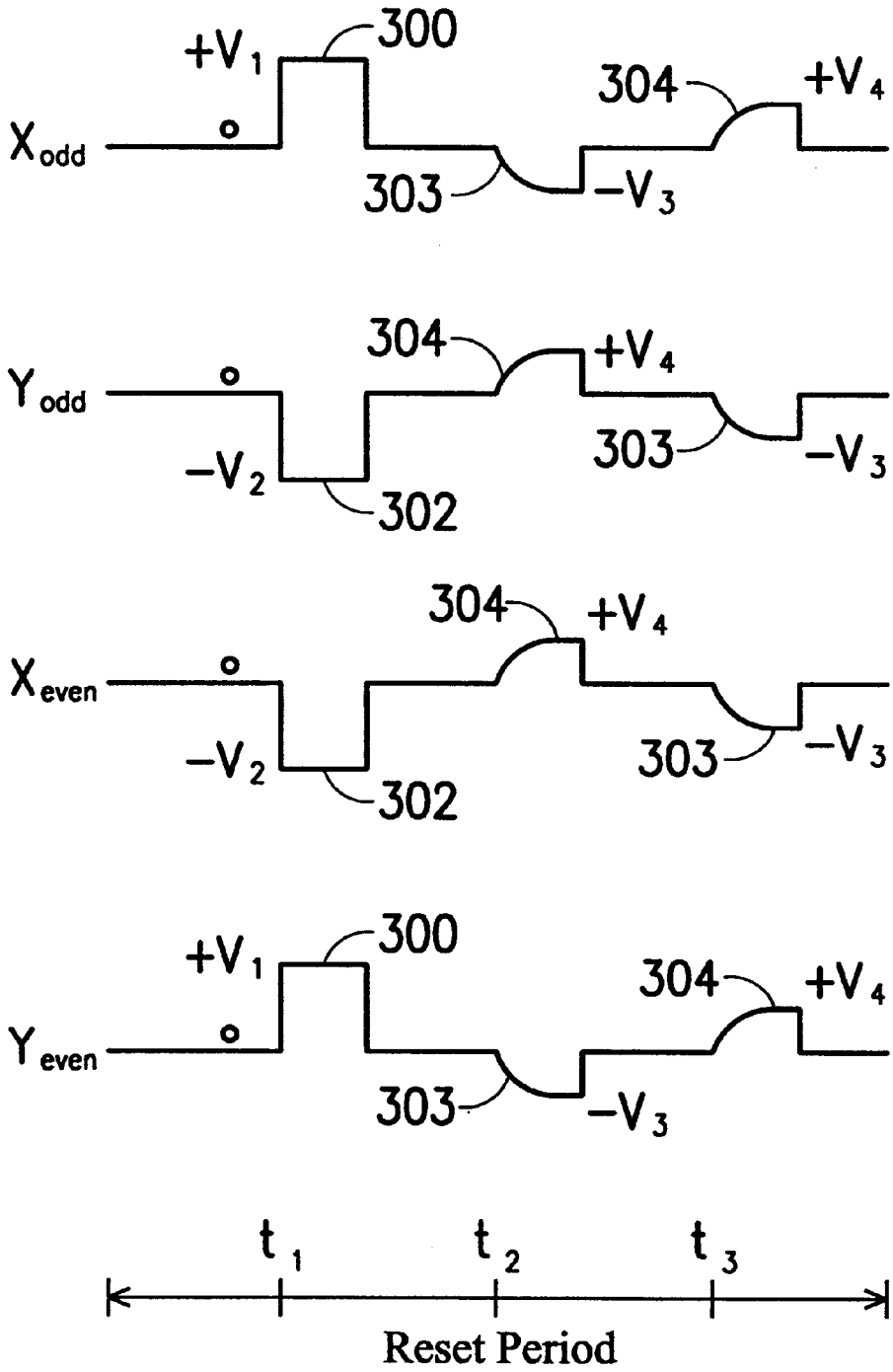
FIG. 6 is a timing diagram of the control signal on the sustaining electrodes and scanning electrodes in the reset period of the sub-field, according to the driving method of the first embodiment of the present invention.

FIG. 6 is a timing diagram of the voltage waveform on each electrode (including both the odd sustaining electrodes $X_{odd}$ and the even sustaining electrode $X_{even}$ of the sustaining electrodes $X_1$~$X_9$ and the odd scanning electrodes $Y_{odd}$ and the even scanning electrodes $Y_{even}$ of the scanning electrodes $Y_1$~$Y_8$) in the reset period of the sub-field, according to the driving method of the present invention.

As illustrated in FIG. 6, at the first timing point $t_1$ of the reset period, a first driving voltage pulse 300 is sent to the odd sustaining electrodes $X_{odd}$ of the sustaining electrodes $X_j$ and the even scanning electrodes $Y_{even}$ of the scanning electrodes $Y_j$, and a second driving voltage pulse 302 is sent to the odd scanning electrodes $Y_{odd}$ of the scanning electrodes $Y_j$ and the even sustaining electrodes $X_{even}$ of the sustaining electrodes $X_j$. The first driving voltage pulse 300 has a voltage of V1, and the second driving voltage pulse 302 has a voltage of −V2. As a result, a global writing voltage difference $V_w(=V_1+V_2)$ is applied between each adjacent pair of the odd scanning electrodes $Y_{odd}$ and the odd sustaining electrodes $X_{odd}$, and each adjacent pair of the even scanning electrodes $Y_{even}$ and the even sustaining electrodes $X_{even}$. But no such voltage difference is applied between each pair of adjacent odd scanning electrodes $Y_{odd}$ and even sustaining electrodes $X_{even}$, and each pair of adjacent even scanning electrodes $Y_{even}$ and odd sustaining electrodes $X_{odd}$.

In the embodiment, the first driving voltage pulse 300 is +180 volts ($V_1$=180), and the second driving signal 302 is −180 volts ($-V_2$=−180). Hence, there is a global writing voltage difference $V_w$ of 360 volts between each electrode pair $X_1$-$Y_1$, $X_2$-$Y_2$, $X_3$-$Y_3$, $X_4$-$Y_4$, $X_5$-$Y_5$, $X_6$-$Y_6$, $X_7$-$Y_7$, and $X_8$-$Y_8$. Because the global writing voltage difference $V_w$ is greater than the firing voltage between the scanning electrodes $Y_j$ and the sustaining electrodes $X_j$, each electrode pairs $X_1$-$Y_1$, $X_2$-$Y_2$, $X_3$-$Y_3$, $X_4$-$Y_4$, $X_5$-$Y_5$, $X_6$-$Y_6$, $X_7$-$Y_7$, and $X_8$-$Y_8$ will start discharging in the dark areas $G_1$, $G_2$, $G_3$, $G_4$, $G_5$, $G_6$, $G_7$, and $G_8$, and then accumulate wall charges.

In addition, the voltage difference between each electrode pair $Y_1$-$X_2$, $Y_2$-$X_3$, $Y_3$-$X_4$, $Y_4$-$X_5$, $Y_5$-$X_6$, $Y_6$-$X_7$, $Y_7$-$Y_8$ and $Y_8$-$X_9$ is 0. So, no discharge operation occurs between the scanning electrodes $Y_j$ and sustaining electrodes $X_{j+1}$ in the display areas $D_1$~$D_8$.

From the description hereinbefore, it is clear that the global writing voltage difference $V_w$ in the reset period makes the global writing discharge occur only between the electrode pairs $X_1$-$Y_1$, $X_2$-$Y_2$, $X_3$-$Y_3$, $X_4$-$Y_4$, $X_5$-$Y_5$, $X_6$-$Y_6$, $X_7$-$Y_7$, and $X_8$-$Y_8$. In other words, the global writing discharge occurred in the dark areas $G_1$, $G_2$, $G_3$, $G_4$, $G_5$, $G_6$, $G_7$, and $G_8$, but not in the display areas $D_1$~$D_8$. Hereby, the driving method of the present invention, on one hand, the global writing discharges produce a lot of space charges, wall charges and priming particles. Owing to the priming particles produced in the dark areas can be diffused to the display areas, the firing voltage of the gas is reduced and the following gas discharges such as addressing discharges and sustaining discharge are improved. On the other hand, if a black matrix is incorporated into the dark areas $G_1$, $G_2$, $G_3$, $G_4$, $G_5$, $G_6$, $G_7$, and $G_8$, the brightness displayed during the reset period will be further reduced; hence, the contrast ratio is increased.

In order to eliminate the residual wall charges described hereof, after the first timing point $t_1$ (for example: the second timing point $t_2$), (a) send a third driving voltage pulse 303 to the odd sustaining electrodes $X_{odd}$ and the even scanning electrodes $Y_{even}$; (b) send a forth driving voltage pulse 304 to the even sustaining electrodes $X_{even}$ and the odd scanning electrodes $Y_{odd}$. Hence, a first erase voltage waveform is applied on the odd sustaining electrodes $X_{odd}$ and the even scanning electrodes $Y_{even}$, and a second erase voltage waveform is applied between the even sustaining electrodes $X_{even}$ and the odd scanning electrodes $Y_{odd}$. Similarly, the applied voltage at the second timing point $t_2$ only cause discharge operations at the dark areas $G_1$~$G_8$, but not the display areas $D_1$~$D_8$.

As follows, at the third timing point $t_3$ of the reset period, in order to fully eliminate the residual wall charges, the third and the forth driving voltage waveforms 303 and 304 are sent respectively to the sustaining electrodes and the scanning electrodes in the manner described hereinbefore.

In the present embodiment, it is assumed that $V_3$=$V_4$=90V; if $V_3$=0, then $V_4$=180V; if $V_3$=180V, then $V_4$=0V.

So, at the second timing point $t_2$, a first erase voltage difference $V_{c1}$ of −180V is applied to any of the odd electrode pairs $X_1$-$Y_1$, $X_3$-$Y_3$, $X_5$-$Y_5$, and $X_7$-$Y_7$, and a second erase voltage difference $V_{c2}$ is applied on any of the even electrode pairs, $X_2$-$Y_2$, $X_4$-$Y_4$, $X_6$-$Y_6$, and $X_8$-$Y_8$, to eliminate the excessive wall charges left on the bi-electric layer near the electrodes As described, at the third timing point $t_3$, with the external voltage charges reversed, the first erase voltage difference $V_{c1}$ of 180V and the second erase voltage difference $V_{c2}$ of −180V, are respectively applied to each odd electrode pairs and even electrode pairs.

The first driving signal 300 and the second driving signal 302 are respectively set as [−180V, 180V], [360V, 0V], [0V, 360V] and so forth, if that the voltage differences between the two are greater than the firing voltage described above.

Figure 7:
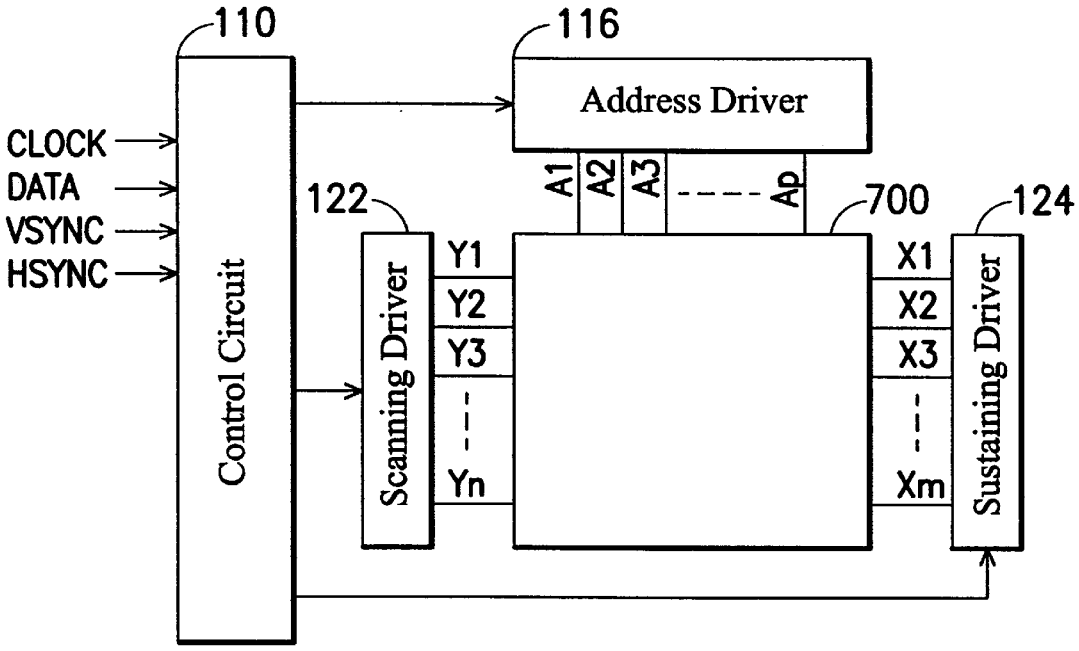
FIG. 7 is a block diagram of the present invention.

Referring to FIG. 7, a block diagram of the PDP driving device of the present invention. The driving device comprises a control circuit 110, an address driver 116, a scan driver 122, and a sustaining driver 124. The control circuit 110 receives timing signals comprises the external clock signal CLOCK, the data signal DATA, the vertical synchronous signal VSYNC and the horizontal synchronous signal HSYNC and have them distributed to each individual drivers. The address driver 116 drives the address electrodes $A_1$~$A_p$ and write the display data into the cells at the address period. The scan driver 122 drives the scanning electrodes $Y_1$~$Y_n$; and the sustaining driver 124 drives the sustaining electrodes $X_1$~$X_m$. As shown in FIG. 5, 700 of the PDP is driven by the parallel scanning electrodes $Y_1$~$Y_n$ and the sustaining electrodes $X_1$~$X_m$, and the (not illustrated herein) address electrodes $A_1$~$A_p$.

As illustrated in FIG. 6, the global writing voltage difference $V_w$ at the first timing point $t_1$ in the reset period of each sub-field sent by the sustaining driver 124 causes the global address discharge operations to occur between each electrode pair $X_j$-$Y_j$ in the corresponding dark areas $G_j$, but not in the display areas $D_j$. Consequently, the brightness displayed during the discharge operation will be effectively shielded and reduced, and still keeps a large amount of wall discharge accumulated, hence achieves high contrast of the PDP display.

As illustrated hereof, the PDP driving method of the embodiment are applied mainly in the reset period, is used to accumulate a large amount of wall discharges by applying a global voltage difference on the sustaining electrodes and the scanning electrodes in the dark areas, and not cause strong brightness during discharge operations assuring good quality of the pictures. Moreover, it only needs minor modification on part of the original driver circuit for the global writing voltage difference desired, which will not cost much and hence meet the practical demand.

Figure 8:
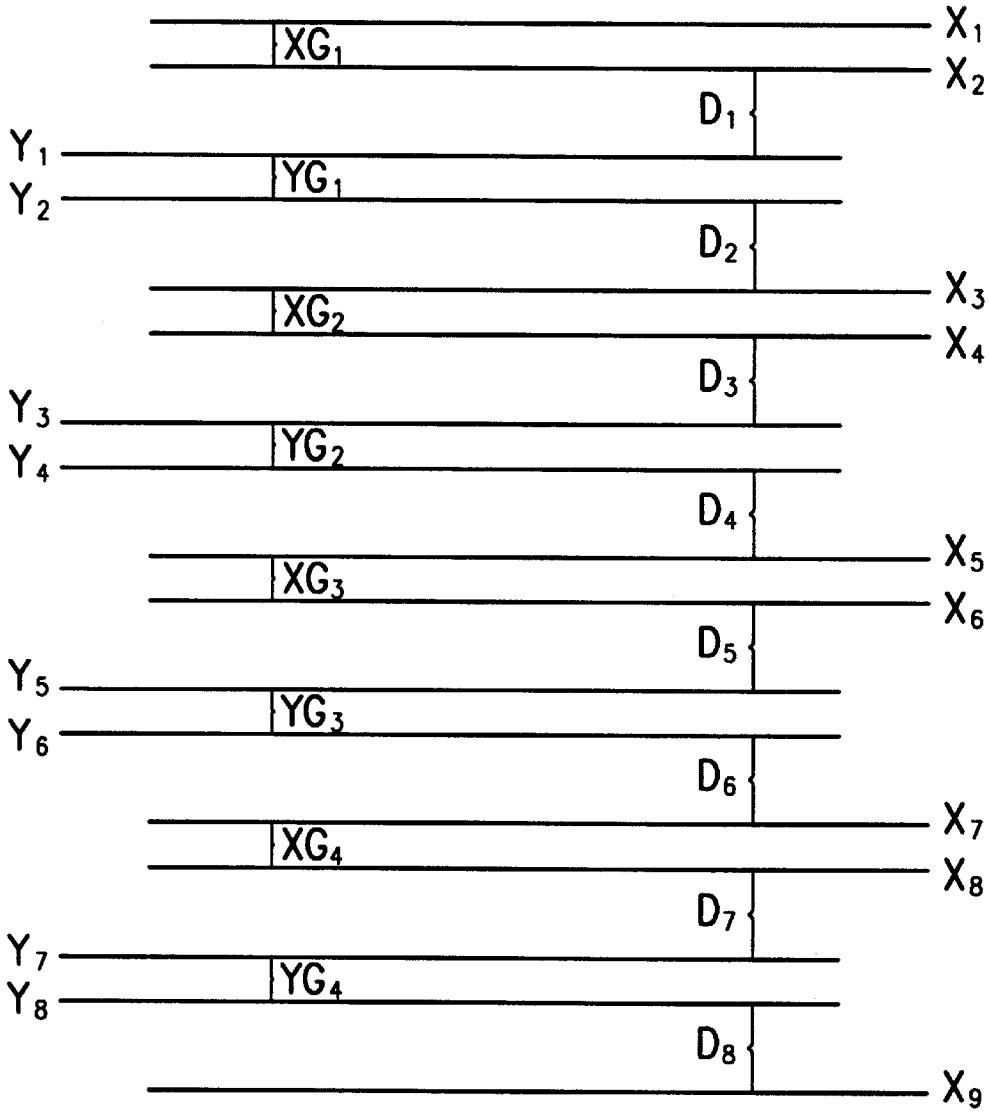
FIG. 8 is a schematic diagram of the sustaining electrodes and the scanning electrodes on the PDP (XX-YY-XX-YY) of the second embodiment of the present invention.

FIG. 8 is a schematic diagram of the sustaining electrodes and the scanning electrodes on the PDP of the second embodiment of the present invention. The PDP herein includes a plurality of sustaining electrodes ($X_1$~$X_m$) and scanning electrodes ($Y_1$~$Y_n$) configured in parallel in the following manner: $X_1X_2$-$Y_1Y_2$-$X_3X_4$-$Y_3Y_4$ . . . , and a plurality of address electrodes across the sustaining electrodes and the scanning electrodes hereof. For the purpose of illustration, the PDP in FIG. 8 has adopted the configuration of 9 sustaining electrodes ($X_1$~$X_9$) and 8 scanning electrodes ($Y_1$~$Y_8$) as the example. The space between any of the scanning electrodes pairs described: $Y_1$-$Y_2$, $Y_3$-$Y_4$, $Y_5$-$Y_6$ and $Y_7$-$Y_8$, along with the space between the sustaining electrode pairs described: $X_1$-$X_2$, $X_3$-$X_4$, $X_5$-$X_6$ and $X_7$-$X_8$, are defined as the dark areas $YG_1$, $YG_2$, $YG_3$, $YG_4$, $XG_1$, $XG_2$, $XG_3$ and $XG_4$. The space between the sustaining electrodes $Y_j$ and $X_{j+1}$ is defined as the display areas $D_j$ (j<8).

Figure 9:
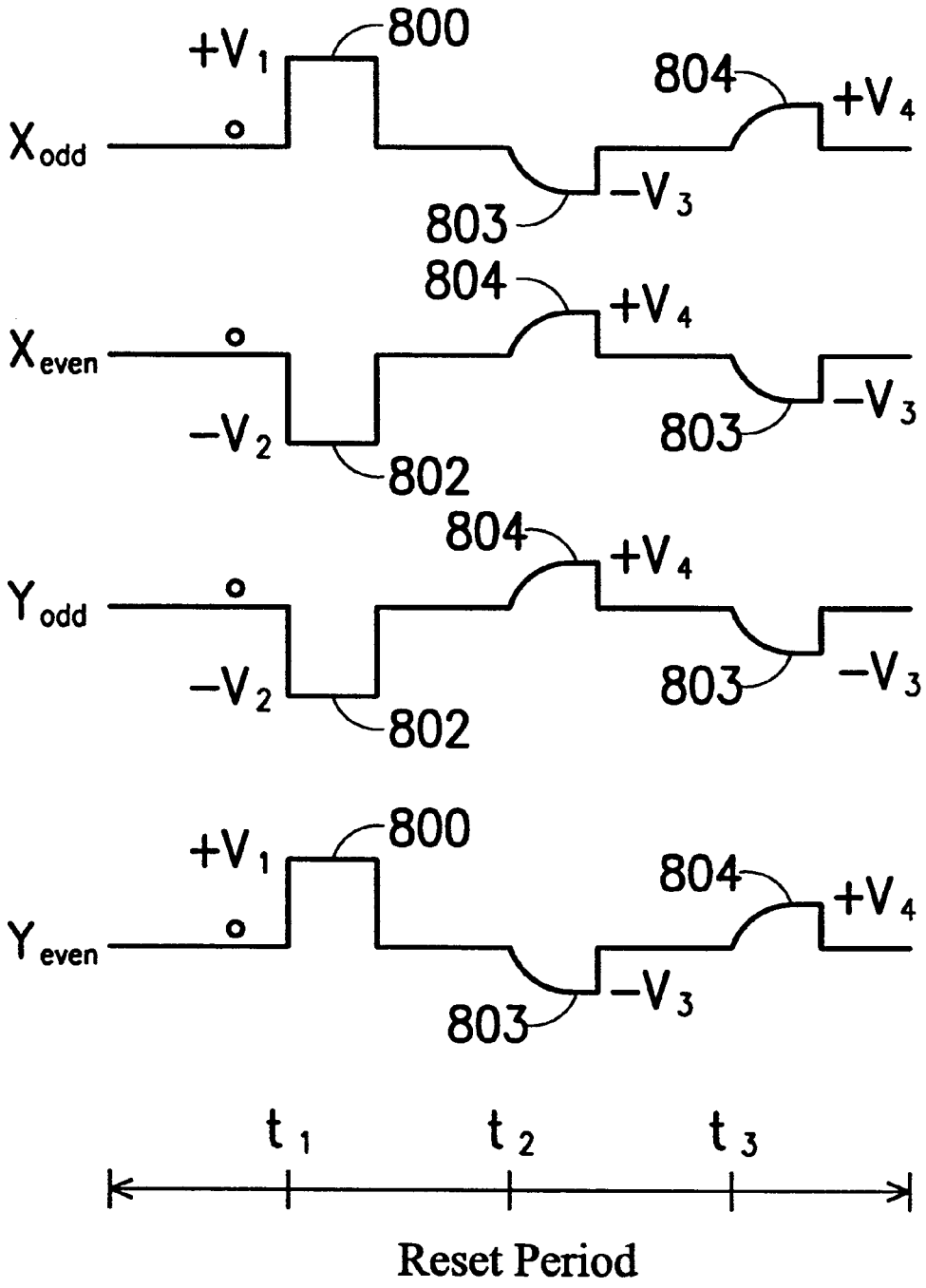
FIG. 9 is a timing diagram of the control signal on the sustaining electrodes and scanning electrodes in the reset period of the sub-field, according to the driving method of the second embodiment of the present invention.

FIG. 9 is a timing diagram of the control signal on each electrode (including both the odd sustaining electrodes $X_{odd}$ and the even sustaining electrode $X_{even}$ of the sustaining electrodes $X_1$~$X_9$ and the odd scanning electrodes $Y_{odd}$ and the even scanning electrodes $Y_{even}$ of the scanning electrodes $Y_1$~$Y_8$). in the reset period the sub-field of the embodiment of the present invention.

As illustrated in FIG. 9, at the first timing point $t_1$ of the reset period, a first driving signal 800 is sent to the odd sustaining electrodes $X_{odd}$ of the sustaining electrodes $X_j$ and the even scanning electrodes $Y_{even}$ of the scanning electrodes $Y_j$, and a second driving signal 802 is sent to the odd scanning electrodes $Y_{odd}$ of the scanning electrodes $Y_j$ and the even sustaining electrodes $X_{even}$ to the sustaining electrodes $X_j$. As the result of the applications hereof, a global writing voltage difference $V_w(=V_1+V_2)$ is applied on the sustaining electrode pairs $X_1$-$X_2$, $X_3$-$X_4$, $X_5$-$X_6$ and $X_7$-$X_8$, and scanning electrode pairs $Y_1$-$Y_2$, $Y_3$-$Y_4$, $Y_5$-$Y_6$ and $Y_7$-$Y_8$. But no such voltage difference is applied the X-Y electrode pairs $X_2$-$Y_1$, $X_3$-$Y_2$, $X_4$-$Y_3$, $X_5$-$Y_4$, $X_6$-$Y_5$, $X_7$-$Y_6$, $X_8$-$Y_7$ $X_7$-$X_8$, and $X_9$-$Y_8$.

In the embodiment, the first driving signal 800 is +180 volts ($V_1$=180), and the second driving signal 802 is −180 volts ($-V_2$=−180). Hence, there is a global writing voltage difference $V_w$ of 360 volts between the sustaining electrode pairs $X_1$-$X_2$, $X_3$-$X_4$, $X_5$-$X_6$ and $X_7$-$X_8$, and the scanning electrode pairs $Y_1$-$Y_2$, $Y_3$-$Y_4$, $Y_5$-$Y_6$, and $Y_7$-$Y_8$. Because the global writing voltage difference $V_w$ is greater than the firing voltage between the scanning electrode pairs and the sustaining electrode pairs described above, the sustaining electrode pairs $X_1$-$X_2$, $X_3$-$X_4$, $X_5$-$X_6$, $X_7$-$X_8$ and scan electro pairs $Y_1$-$Y_2$, $Y_3$-$Y_4$, $Y_5$-$Y_6$, $Y_7$-$Y_8$ will proceed with the discharge operations in the dark areas $XG_1$, $XG_2$, $XG_3$, $XG_4$, $YG_1$, $YG_2$, $YG_3$, and $YG_4$ and accumulate wall charges.

In addition, the voltage difference between each electrode pairs $X_2$-$Y_1$, $Y_2$-$X_3$, $X_4$-$Y_3$, $Y_4$-$X_5$, $X_6$-$Y_5$, $Y_6$-$X_7$, $X_8$-$Y_7$, and $Y_8$-$X_9$ are 0. So, no discharge operation occurs in the display areas $D_1$~$D_8$.

From the above description, it is clear that the global writing voltage difference $V_w$ in the reset period results in the global writing discharge that occur only between the electrode pairs $X_1$-$X_2$, $X_3$-$X_4$, $X_5$-$X_6$, $X_7$-$X_8$ and $Y_1$-$Y_2$, $Y_3$-$Y_4$, $Y_5$-$Y_6$ $Y_7$-$Y_8$ in the dark areas $XG_1$, $XG_2$, $XG_3$, $XG_4$, $YG_1$, $YG_2$, $YG_3$, and $YG_4$, but not in the display areas $D_1$~$D_8$. Because the dark areas $XG_1$~$YG_4$ are much smaller than the display areas $D_1$~$D_8$, the brightness displayed during the discharge process will be shielded and reduced immensely. Hereof, the driving method of the present invention, on one hand, keeps accumulating the large amount of charges needed, on the other hand, will not result in the over-illuminated background, hence increases the contrast. In addition, if a black matrix is incorporated into the dark areas $G_1$, $G_2$, $G_3$, $G_4$, $G_5$, $G_6$, $G_7$, and $G_8$, the displayed brightness at the reset period will be further reduced.

Moreover, the sustaining electrodes and the scanning electrodes can be rearranged to further decrease the area ratio between the dark areas and the display areas, which produces better PDP resolvability and further reduces the display brightness in the reset period.

In order to eliminate the residual wall charges described hereof, after the first timing point $t_1$(for example: the second timing point $t_2$), (a) send a third driving signal 803 to the odd sustaining electrodes $X_{odd}$ and the even scanning electrodes $Y_{even}$; (b) send a forth driving signal 804 to the even sustaining electrodes $X_{even}$ and the odd scanning electrodes $Y_{odd}$. Hence, a first erase voltage difference $V_{c1}$ ($=-V_3-V_4$) is applied on the odd sustaining electrodes $X_{odd}$ and the even sustaining electrodes $X_{even}$, and a second erase signal $V_{c2}$ ($=V_4+V_3$) is applied between the even scanning electrodes $Y_{even}$ and the odd scanning electrodes $Y_{odd}$. Similarly, the applied voltages at the second timing point $t_2$ only cause discharge operations at the dark areas $XG_1$~$XG_4$ and $YG_1$~$YG_4$ but not the display areas $D_1$~$D_8$.

As follows, at the third timing point $t_3$ of the reset period, in order to eliminate the residual wall charges the third and the forth driving signals 303 and 304, with the charges opposite from those at the second timing point $t_2$, are sent to proceed the reverse discharges.

It is assumed that the third driving signal 803 is 0V (as that of 303 in FIG. 6), and the fourth driving signal 804 is +180V.

So, at the second timing point $t_2$, a first erase voltage difference $V_{c1}$ of −180V is applied to any of the odd electrode pairs $X_1$-$Y_1$, $X_3$-$Y_3$, $X_5$-$Y_5$, and $X_7$-$Y_7$, and a second erase voltage difference $V_{c2}$ is applied on any of the even electrode pairs, $X_2$-$Y_2$, $X_4$-$Y_4$, $X_6$-$Y_6$, and $X_8$-$Y_8$, to eliminate the excessive wall charges left on the bi-electric layer near the electrodes.

At the third timing point $t_3$, with the external voltage charges reversed, the first erase voltage difference $V_{c1}$ of 180V and the second erase voltage difference $V_{c2}$ of −180V, are respectively applied to each sustaining electrode pairs and scanning electrode pairs.

The first driving signal 800 and the second driving signal 802 are respectively set as [−180V, 180V], [360V, 0V], [0V, 360V] and so forth, if that the voltage differences between the two are greater than the firing voltage described above.

The block diagram of the PDP driving device of the embodiment is similar to that shown in FIG. 7. Referring to FIG. 7, the driving device comprises a control circuit 110, an address driver 116, a scan driver 122, and a sustaining driver 124. The control circuit 110 receives timing signals comprises the external clock signal CLOCK, the data signal DATA, the vertical synchronous signal VSYNC and the horizontal synchronous signal HSYNC and have them distributed to each individual drivers. The address driver 116 drives the address electrodes $A_1$~$A_p$ and writes the display data into the cells at the address period. The scan driver 122 drives the scanning electrodes $Y_1$~$Y_n$; and the sustaining driver 124 drives the sustaining electrodes $X_1$~$X_m$. As shown in FIG. 5, 700 of the PDP is driven by the parallel scanning electrodes $Y_1$~$Y_n$ and the sustaining electrodes $X_1$~$X_m$, and the (not illustrated herein) address electrodes $A_1$~$A_p$.

As illustrated in FIG. 6, the global writing voltage difference $V_w$ at the first timing point $t_1$, in the reset period of each sub-field sent by the sustaining driver 124 causes the global address discharge operations to occur between each of the electrode pairs $X_1$-$X_2$~$X_7$-$X_8$ and $Y_1$-$Y_2$~$Y_7$-$Y_8$ in the corresponding dark areas $XG_1$~$XG_4$ and $YG_1$~$YG_4$, but not in the display areas $D_1$~$D_8$. Consequently, the brightness displayed during the discharge operation will be effectively shielded and reduced, and still will keep a large quantity of accumulated wall discharge, hence achieving the desired high contrast of the PDP display.

As illustrated hereof, the PDP driving method of the embodiment are applied mainly in the reset period, is used to accumulate a large amount of wall discharge by applying a global voltage difference on the sustaining electrodes and the scanning electrodes in the dark areas, and not cause strong brightness during the discharge operation assuring the good quality of the pictures. Moreover, it only needs minor modifications on part of the original driver circuit to generate the global writing voltage difference desired, which does not cost much and hence meet the practical demand.

While the invention has been described by way of example and in terms of the preferred embodiment, it is to be understood that the invention is not limited to the disclosed embodiments. On the contrary, it is intended to cover various modifications and similar arrangements as would be apparent to those skilled in the art. Similarly, any process steps described herein may be interchangeable with other steps in order to achieve the same result. Therefore, the scope of the appended claims should be accorded the broadest interpretation so as to encompass all such modifications and similar arrangements, which is defined by the following claims and their equivalents.

What is claimed is:

1. A PDP driving method, with a plurality of sustaining electrodes (X1~Xm), a plurality of scanning electrodes (Y1~Yn), configured in an alternate sequence as X1-Y1-X2-Y2-X3-Y3 . . . Xm-Yn on said PDP, and a plurality of address electrodes cross over said sustaining electrodes and scanning electrodes, wherein:

according to the sequence, said sustaining electrodes (X1~Xm) are divided into odd sustaining electrodes (Xodd) and even sustaining electrodes (Xeven), and said scanning electrodes (Y1~Yn) are divided into odd scanning electrodes (Yodd) and even scanning electrodes (Yeven);

dark areas (Gj) are located between said odd scanning electrodes (Yodd) and said odd sustaining electrodes (Xodd), and said even scanning electrodes (Yeven) and said even sustaining electrodes (Xeven), in which no display data is written, and display areas (Dj), written with display data, are located between said odd scanning electrodes (Yodd) and said even sustaining electrodes (Xeven), and between said even scanning electrodes (Yeven) and said odd sustaining electrodes (Xodd), wherein, n, m and j are integers, and $1 \leqq j \leqq n$ and m;

when a voltage difference between adjacent said sustaining electrodes (X1~Xm) and said scanning electrodes (Y1~Yn) is greater than a firing voltage, said adjacent sustaining electrodes (X1~Xm) and scanning electrodes (Y1~Yn) start a discharge operation in said dark areas (Gj) and display areas (Dj), said driving method comprising the following steps (a) at a first timing point in a reset period, a first driving voltage pulse is sent to said odd sustaining electrodes (Xodd) and said even scanning electrodes (Yeven), and a second driving voltage pulse is sent to said odd scanning electrodes (Yodd) and said even sustaining electrodes (Xeven), wherein a first voltage difference, generated by said first and second driving voltage pulses, between every said adjacent pair of said odd scanning electrodes (Yodd) and odd sustaining electrodes (Xodd), and every said adjacent pair of said even scanning electrodes (Yeven) and even sustaining electrodes (Xeven) has to be above said firing voltage so as to make said discharge operation occur in said dark areas (Gj); and (b) at said first timing point in the reset period, a second voltage difference, generated by said first and second driving voltage pulses, between every said adjacent pair of odd scanning electrodes (Yodd) and even sustaining electrodes (Xeven) has to be below said firing voltage to make said discharge operation not occur in said display areas (Dj), wherein the voltage of one of said first driving voltage pulse and said second driving voltage pulse is zero.

2. The driving method as claimed in claim 1, wherein said first driving voltage pulse and said second driving voltage pulse have different electric polarity.

3. A PDP driving method, with a plurality of sustaining electrodes (X1~Xm), a plurality of scanning electrodes (Y1~Yn), configured in an alternate sequence as X1-Y1-X2-Y2-X3-Y3 . . . Xm-Yn on said PDP, and a plurality of address electrodes cross over said sustaining electrodes and scanning electrodes, wherein:

according to the sequence, said sustaining electrodes (X1~Xm) are divided into odd sustaining electrodes (Xodd) and even sustaining electrodes (Xeven), and said scanning electrodes (Y1~Yn) are divided into odd scanning electrodes (Yodd) and even scanning electrodes (Yeven);

dark areas (Gj) are located between said odd scanning electrodes (Yodd) and said odd sustaining electrodes (Xodd), and said even scanning electrodes (Yeven) and said even sustaining electrodes (Xeven), in which no display data is written, and display areas (Dj), written with display data, are located between said odd scanning electrodes (Yodd) and said even sustaining electrodes (Xeven), and between said even scanning electrodes (Yeven) and said odd sustaining electrodes (Xodd), wherein, n, m and j are integers, and $1 \leqq j \leqq n$ and m;

when a voltage difference between adjacent said sustaining electrodes (X1~Xm) and said scanning electrodes (Y1~Yn) is greater than a firing voltage, said adjacent sustaining electrodes (X1~Xm) and scanning electrodes (Y1~Yn) start a discharge operation in said dark areas (Gj) and display areas (Dj), said driving method comprising the following steps (a) at a first timing point in a reset period, a first driving voltage pulse is sent to said odd sustaining electrodes (Xodd) and said even scanning electrodes (Yeven), and a second driving voltage pulse is sent to said odd scanning electrodes (Yodd) and said even sustaining electrodes (Xeven), wherein a first voltage difference, generated by said first and second driving voltage pulses, between every said adjacent pair of said odd scanning electrodes (Yodd) and odd sustaining electrodes (Xodd), and every said adjacent pair of said even scanning electrodes (Yeven) and even sustaining electrodes (Xeven) has to be above said firing voltage so as to make said discharge operation occur in said dark areas (Gj);

(b) at said first timing point in the reset period, a second voltage difference, generated by said first and second driving voltage pulses, between every said adjacent pair of odd scanning electrodes (Yodd) and even sustaining electrodes (Xeven) has to be below said firing voltage to make said discharge operation not occur in said display areas (Dj); and (c) at a second timing point following said first timing point in the reset period, applying a third voltage pulse to said even scanning electrodes (Yeven) and said odd sustaining electrodes (Xodd), and applying a fourth driving voltage pulse to said odd scanning electrodes (Yodd) and said even sustaining electrodes (Xeven).

4. The driving method as claimed in claim 3, the driving method further comprising the following step:

(d) at a third timing point following said second timing point in the reset period, applying said third driving voltage pulse to said odd scanning electrodes (Yodd) and said even sustaining electrodes (Xeven), and applying said fourth driving voltage pulse to said even scanning electrodes (Yeven) and said odd sustaining electrodes (Xodd), whereas said third driving voltage pulse and said fourth driving voltage pulse have different electric polarities.

5. The driving method as claimed in claim 4, wherein one of said third driving voltage pulse and said fourth voltage pulse is zero.

6. The driving method as claimed in claim 3, wherein said first driving voltage pulse and said second driving voltage pulse have different electric polarity.

7. A PDP driving method, with a plurality of sustaining electrodes (X1~Xm), a plurality of scanning electrodes (Y1~Yn), configured in a sequence as X1-X2-Y1-Y2-X3-X4 . . . Xm-1-Xm-Yn-1-Yn, and a plurality of address electrodes cross over said sustaining electrodes and said scanning electrodes, wherein:

said scanning electrodes (Y1~Yn) are divided into odd scanning electrodes (Yodd) and even scanning electrodes (Yeven);

dark areas (XGj or YGj), are defined between every two adjacent sustaining electrodes of said odd sustaining electrodes (Xodd) and said even sustaining electrodes (Xeven), and every two adjacent scanning electrodes of said odd scanning electrodes (Yodd) and said even scanning electrodes (Yeven), in which no display data is written, and display areas (Dj), written with display data, are defined between every two adjacent electrodes of said odd scanning electrodes (Yodd) and said even sustaining electrodes (Xeven), and between every two adjacent electrodes of said even scanning electrodes (Yeven) and said odd sustaining electrodes (Xodd), wherein, n, m and j are integers, and $1 \leqq j \leqq n$ and m;

when a voltage difference between adjacent said sustaining electrodes (X1~Xm) and said scanning electrodes (Y1~Yn) is greater than a firing voltage, said adjacent sustaining electrodes (X1~Xm) and scanning electrodes (Y1~Yn) start a discharge operation in said dark areas (XGj or YGj) and display areas (Dj), the driving method comprising the following steps:

(a) at a first timing point in a reset period, a first driving voltage pulse is sent to said odd sustaining electrodes (Xodd) and said even scanning electrodes (Yeven), and a second driving voltage pulse is sent to said even sustaining electrodes (Xeven) and odd scanning electrodes (Yodd); wherein a first voltage difference, generated by said first and second driving voltage pulses, between every said adjacent pair of said even sustaining electrodes (Xeven) and odd sustaining electrodes (Xodd), and every said adjacent pair of said even scanning electrodes (Yeven) and odd scanning electrodes (Yodd) has to be above said firing voltage so as to make said discharge operation occur in said dark areas (XGj or YGj); and (b) at said first timing point in the reset period, a second voltage difference, generated by said first and second driving voltage pulses, between every said adjacent pair of odd scanning electrodes (Yodd) and even sustaining electrodes (Xeven), and every said adjacent pair of even scanning electrodes (Yeven) and odd sustaining electrodes (Xodd) has to be below said firing voltage to make said discharge operation not occur in said display areas (Dj).

8. The driving method as claimed in claim 7, the driving method further comprising the step of:

(c) at a second timing point following said first timing point in the reset period, applying a third voltage pulse to said odd sustaining electrodes (Xodd) and said even scanning electrodes (Yeven), and said even sustaining electrodes (Xeven) and said odd scanning electrodes (Yodd).

9. The driving method as claimed in claim 8, the driving method further comprising the step of:

(d) at a third timing point following said second timing point in the reset period, applying said third driving voltage pulse to said odd scanning electrodes (Yodd) and said even sustaining electrodes (Xeven), and applying said fourth driving voltage pulse to said even scanning electrodes (Yeven) and said odd sustaining electrodes (Xodd), whereas said third driving voltage pulse and said fourth driving voltage pulse have different electric polarity.

* * * * *